US006433291B1

(12) United States Patent
Mori et al.

(10) Patent No.: US 6,433,291 B1
(45) Date of Patent: Aug. 13, 2002

(54) SWITCH DEVICE

(75) Inventors: Toshiharu Mori; Yoshio Tanabe, both of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/922,301

(22) Filed: Aug. 3, 2001

(30) Foreign Application Priority Data

Aug. 11, 2000 (JP) ..... 2000-249185

(51) Int. Cl.[7] ..... H01H 5/10

(52) U.S. Cl. ..... 200/437; 200/434; 200/439; 200/520; 200/533

(58) Field of Search ..... 200/405, 431, 200/434, 437, 438, 439, 449, 450, 520, 523, 524, 529, 533, 534

(56) References Cited

U.S. PATENT DOCUMENTS

| | | | | | |
|---|---|---|---|---|---|
| 3,999,024 | A | * | 12/1976 | Marquardt | 200/437 |
| 4,286,125 | A | * | 8/1981 | Schaffeler et al. | 200/522 |
| 4,523,176 | A | * | 6/1985 | Leibinger et al. | 200/533 |
| 4,543,459 | A | * | 9/1985 | Hayashida | 200/453 |
| 4,816,630 | A | * | 3/1989 | Honda et al. | 200/314 |
| 6,166,345 | A | | 12/2000 | Ito et al. | 200/437 |

* cited by examiner

*Primary Examiner*—Michael Friedhofer
(74) *Attorney, Agent, or Firm*—Beyer Weaver & Thomas, LLP

(57) ABSTRACT

In a switch device, a support arm is retained by a conductor plate at one of its ends and by a center terminal at its other end The spring member, which made of an elastic round wire, is placed in a bent form between the conductor plate and the center terminal so as to movably support the conductor plate on the center terminal. The support arm and the spring member are retained by the conductor plate and the center terminal on arc-shaped surfaces.

5 Claims, 8 Drawing Sheets

SWITCH DEVICE

BACKGROUND OF THE INVENTION

1. Field of the Invention

The present invention relates to a switch device used as a power switch of an electronic device, and more particularly, to the structure of a quick-acting switch device in which contacts are opened and closed by using the inversion of a spring.

2. Description of the Related Art

The structure of a conventional quick-acting switch device is shown in FIGS. 13 to 15. FIG. 13 is a longitudinal sectional view showing an OFF state of the switch device. FIG. 14 is a longitudinal sectional view showing an ON state of the switch device. FIG. 15 is a partial explanatory view of a contact mechanism section.

The illustrated conventional switch device principally includes a casing 21 made of an insulating material, such as a synthetic resin. A fixed terminal 22 is placed on the inner bottom surface of the casing 21 and has a fixed contact 22*a* on its upper surface. A center terminal 23 is similarly placed on the inner bottom surface of the casing 21 adjacent to the fixed terminal 22. A conductor plate 28 is movably supported by the center terminal 23 and has at one end a movable contact 29 that is movable closer to and further apart from the fixed terminal 22. A support plate 27 is retained by the conductor plate 28 and the center terminal 23 so as to movably support the conductor plate 28, a leaf spring 30 retained in a bent form between the conductor plate 28 and the center terminal 23 so as to move the conductor plate 28 by its bending and stretching motions, and a slide member 31 for moving a projection 30*a* of the leaf spring 30 in contact therewith so as to shift the conductor plate 28 closer to and further apart from the fixed terminal 22.

The center terminal 23 is made of a conductive metal plate or the like, and includes a support plate retaining projection 23*a* for retaining the support plate 27 and a leaf spring retaining projection 23*b* for retaining the leaf spring 30. The support plate retaining projection 23*a* and the leaf spring retaining projection 23*b* have, respectively, retaining V-grooves 23*c* and 23*d* formed nearly opposed to each other. The support plate 27 and the leaf spring 30 are retained at one end by the retaining groves 23*c* and 23*d* respectively.

The support plate 27 is similarly made of a conductive metal plate, is substantially U-shaped, and has an opening at the center where the leaf spring retaining projection 23*b* can be loosely fitted. The support plate 27 is retained by the retaining V-groove 23*c* of the support plate retaining projection 23*a* at one end, and is retained adjacent to the side of the conductor plate 28, where the movable contact 29 is attached, at the other end.

The conductor plate 28 is similarly made of a conductive metal plate, and has at its center an opening where the support plate retaining projection 23*a* and the leaf spring retaining projection 23*b* can be loosely fitted, and the movable contact 29 at one end. The conductor plate 28 is movably mounted on the center terminal 23 while one end of the support plate 27 is retained at one inner end of the opening, and the other end of the opening is retained by the leaf spring 30.

The leaf spring 30 is made of an elastic thin metal plate, and is substantially V-shaped. One end of the leaf spring 30 is retained by the retaining V-groove 23*d* of the leaf spring retaining projection 23*b* of the center terminal 23, and the other end thereof is retained on the inner side of the opening of the conductor plate 28 opposite from the side where the support plate 27 is retained. The leaf spring 30 is placed in a bent form between the center terminal 23 and the conductor plate 28. Adjacent to the top of the nearly V-shaped leaf spring 30, an operating projection 30*a* is formed so as to drive the conductor plate 28 when the slide member 31 slides.

In order to assemble the contact mechanism of the above-described switch device, since the conductor plate 28 is movably mounted on the center terminal 23, the leaf spring 30 must be placed in a bent form between one inner end of the opening of the conductor plate 28 and the leaf spring retaining projection 23*b* of the center terminal 23 in a state in which one end of the support plate 27 is retained at the other inner end of the opening of the conductor plate 28, and the other end of the support plate 27 is retained by the support plate retaining projection 23*a* of the center terminal 23. In this case, since the leaf spring 30 is mounted in an elastically bent form between the conductor plate 28 and the center terminal 23 with the support plate 27 therebetween, the conductor plate 28, the support plate 27, and the leaf spring 30 are movably mounted together on the center terminal 23.

The operation of the above switch device will now be described. When the slide member 31 is pressed, it slides in the pressing direction (rightward in the figure) and presses the adjacency of the top of the V-shaped leaf spring 30, and the leaf spring 30 is pivoted clockwise on the retaining V-groove 23*d* of the leaf spring retaining projection 23*b* of the center terminal 23. In this case, the conductor plate 28 is turned downward together with the support plate 27 on the retaining V-groove 23*c* of the support plate retaining projection 23*a* of the center terminal 23. When the retaining portion between the conductor plate 28 and the leaf spring 30 passes over the retaining V-groove 23*c* (the point of inversion of the leaf spring 30), the conductor plate 28 moves downward and the movable contact 29 contacts the fixed contact 22*a*, thereby closing the circuit. In this case, the slide member 31 is locked in a pressed position.

When the slide member 31 is further pressed in this state, it is unlocked and returned by the urging force of the return spring 26 in a direction (leftward in the figure) opposite from the pressing direction. In this case, when the operating projection 30*a* of the leaf spring 30 is pressed, and the leaf spring 30 is pivoted counterclockwise and passes through the point of inversion, the conductor plate 28 moves upward, and the movable contact 29 separates from the fixed contact 22*a*, thereby opening the circuit.

In the above-described conventional switch device, the leaf spring 30 is used in order to move the conductor plate 28 and, at the inversion of leaf spring 30, to establish a contact between the movable contact 29 and the fixed contact 22*a*. However, since the required load is heavy, the leaf spring 30 must be made of a spring material with a great allowable stress (for example, titanium copper or beryllium copper). This makes it difficult to maintain machinablility and dimensional accuracy, and increases the parts cost.

Furthermore, since the support plate 27 and the leaf spring 30 are made of a platelike material, the shape is complicated, and the material yield is low. Since the support plate 27 and the leaf spring 30 contact with the center terminal 23 at cut edge portions, they are prone to wear, and the reliability of the contact portion is decreased.

SUMMARY OF THE INVENTION

The present invention has been made in order to overcome the above problems, and an object of the invention is to provide a quick-acting switch device in which machinablility and dimensional accuracy can be easily maintained the cost can be reduced, and the reliability of the contact portion can be improved by making a spring member of a contact mechanism of a round wire.

In order to achieve the above object, according to an aspect of the present invention, there is provided a switch device including a fixed contact, a conductor plate having a movable contact which is moved closer to and further apart from the fixed contact, a center terminal for movably supporting the conductor plate, a support arm retained by the conductor plate at one end and retained by the center terminal at the other end, a spring member placed in a bent form between the conductor plate and the center terminal so as to movably support the conductor plate on the center terminal in cooperation with the support arm, and a slide member for moving the movable contact closer to and further apart from the fixed contact by shifting the conductor plate in a direction nearly perpendicular to the sliding direction by the elastic force of the spring member, wherein the support arm and the spring member are made of an elastic wire, and portions of the support arm and the spring member retained by the conductor plate and the center terminal are formed of arc-shaped surfaces.

In this case, the shape is simplified, the material yield is improved, and machinablility and dimensional accuracy can be maintained easily. Moreover, since the support arm and the spring member are retained by the conductor plate and the center terminal on the arc-shaped surfaces, they are less subject to wear, and the reliability of the contact portion is improved.

Preferably, the support arm has a pair of opposing flexible arm pieces, and the arm pieces are elastically urged toward side walls of the conductor plate.

In this case, a reliable contact can be established between the support arm and the conductor plate, and the conductor plate and the center terminal will not be disconnected due to bounce or chattering when the contacts are opened and closed. This improves the reliability of the contact.

Preferably, each of the side wall has a regulating projection with an inclined surface, and the arm pieces are put into elastic contact with the inclined surfaces when the conductor plate shifts in the direction perpendicular to the sliding direction and the movable contact moves in such a direction as to contact with the fixed contact.

In this case, since the elastic contact pressure between the arm pieces and the inclined surfaces is increased with the movement of the conductor plate toward the fixed contact, the reliability of the contact is improved further.

Preferably, the spring member is formed of a helical torsion spring.

In this case, the shape is simplified, machinablility and dimensional accuracy can be easily maintained, and the cost can be reduced, compared with a case in which a leaf spring or the like is formed by press-molding a metal plate. Furthermore, since the spring member is made of a round wire of circular cross section, it is engaged with the center terminal and the conductor plate on the conductor plate's arc-shaped surfaces. Therefore, smooth sliding is possible, scraping or the like are avoided, and the reliability of the contact is improved.

Preferably, the slide member has an operating face portion formed of an inclined surface, the conductor plate has a contact portion to be contacted with the operating face portion, and the operating face portion slides in contact with the contact portion with the sliding of the slide member so as to shift the conductor plate in the direction nearly perpendicular to the sliding direction. This reduces the size and thickness of the switch device.

Further objects, features, and advantages of the present invention will become apparent from the following description of the preferred embodiments with reference to the attached drawings.

DESCRIPTION OF THE PREFERRED EMBODIMENTS

Figure 1:
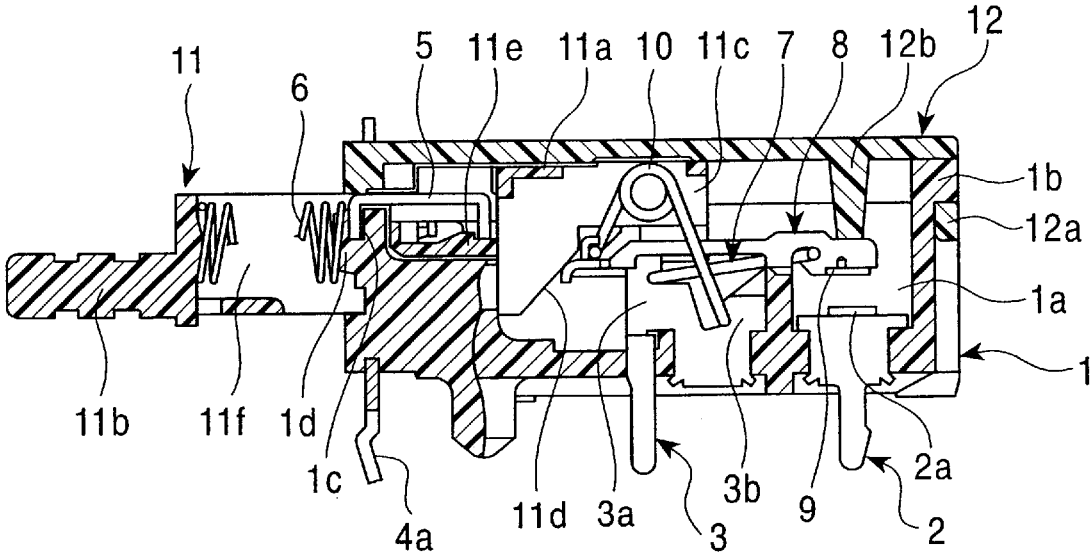
FIG. 1 is a longitudinal sectional view showing an OFF state of a switch device according to an embodiment of the present invention.
Figure 2:
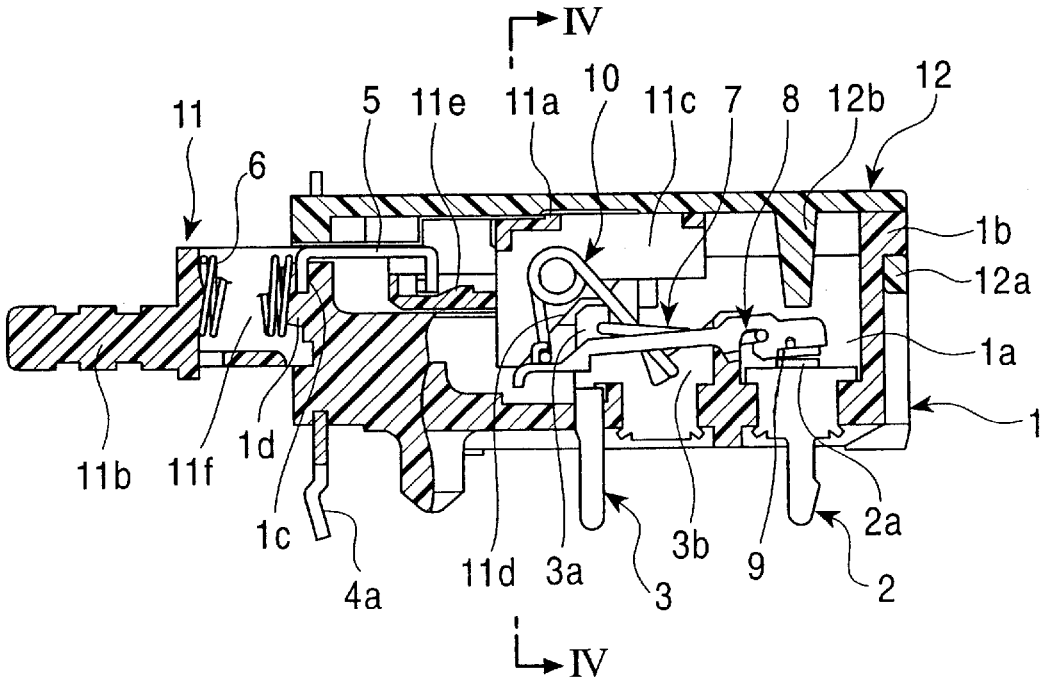
FIG. 2 is a longitudinal sectional view showing an ON state of the switch device.
Figure 3:
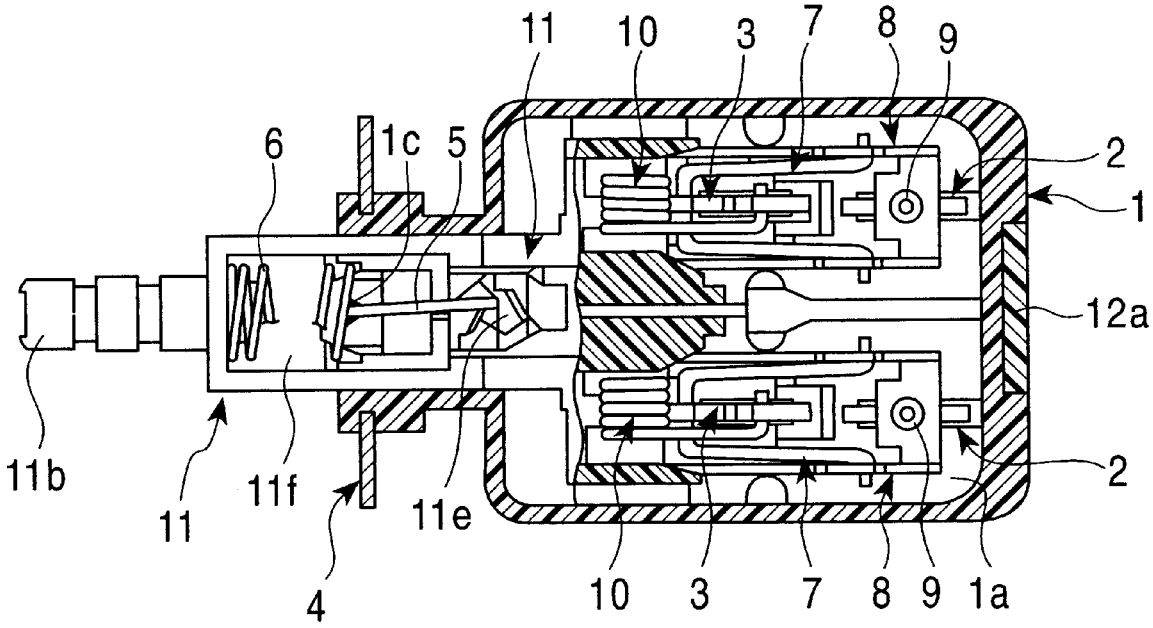
FIG. 3 is a plan view of the switch device in which a cover and a slide member are partly cut away.
Figure 4:
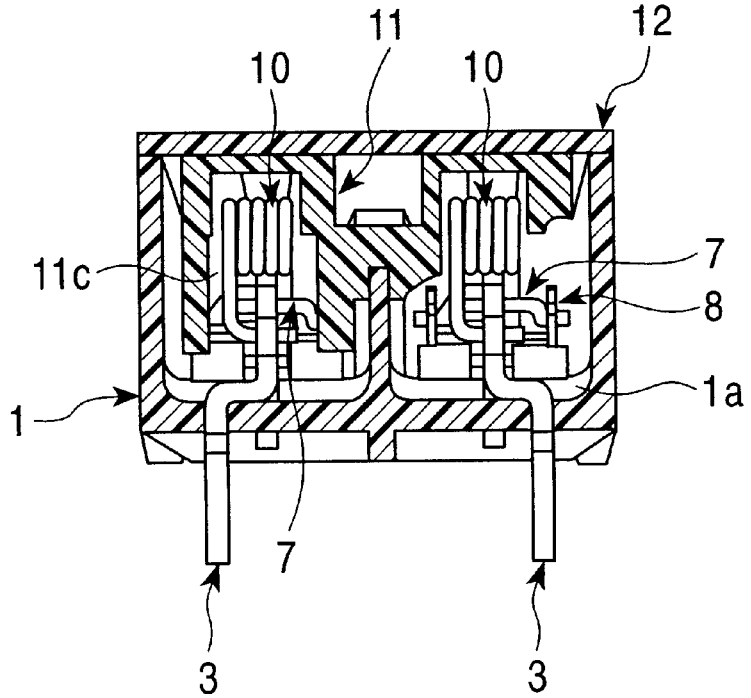
FIG. 4 is a sectional view of the switch device, taken along line IV—IV in FIG. 2.
Figure 5:
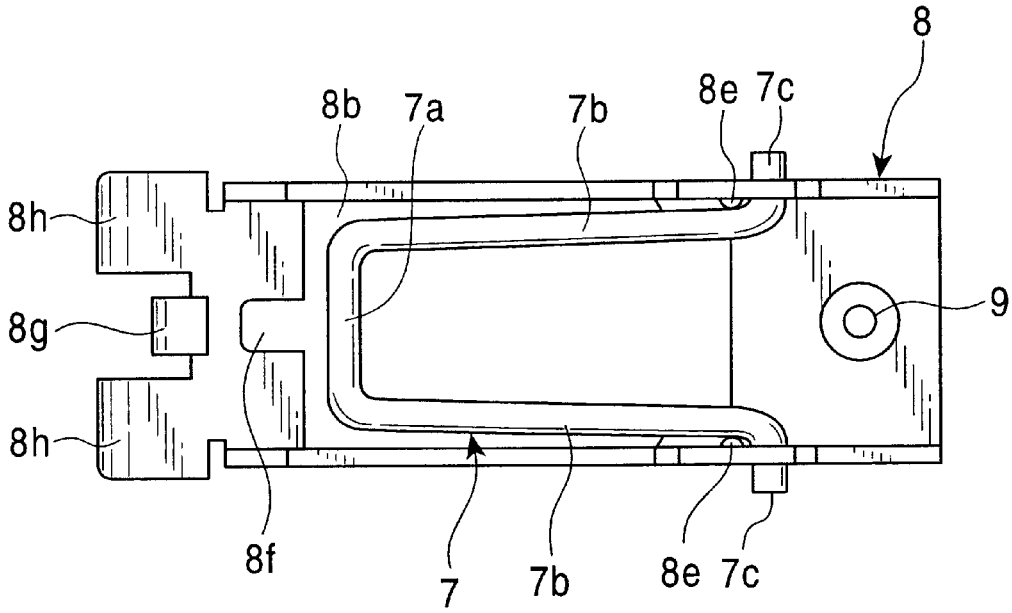
FIG. 5 is a plan view showing the engaging state of a conductor plate and a support arm.
Figure 6:
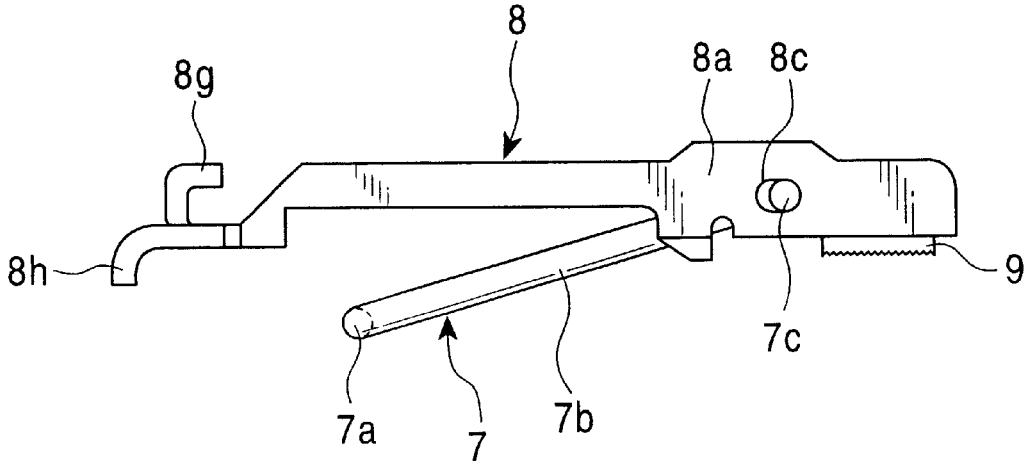
FIG. 6 is a front view showing the engaging state.
Figure 7:
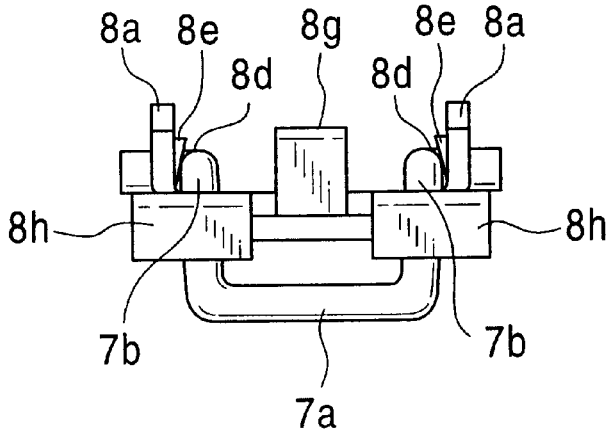
FIG. 7 is a side view showing the engaging state.
Figure 8:
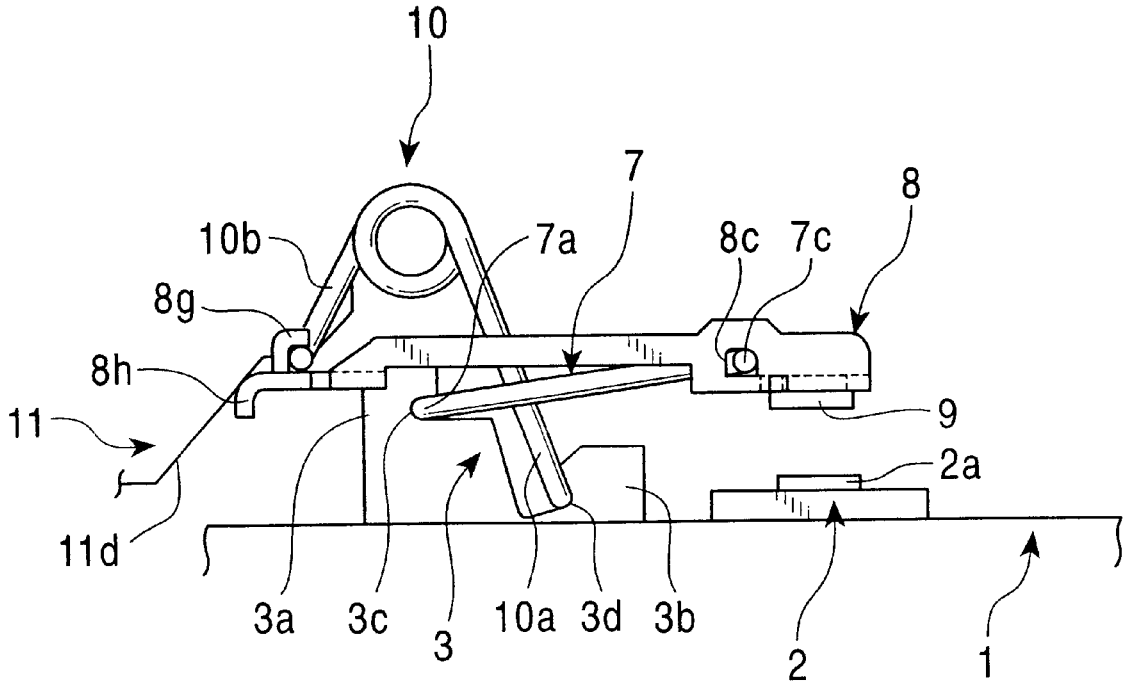
FIG. 8 is an explanatory view showing an initial (OFF) state of a contact mechanism section in the switch device of the present invention.
Figure 9:
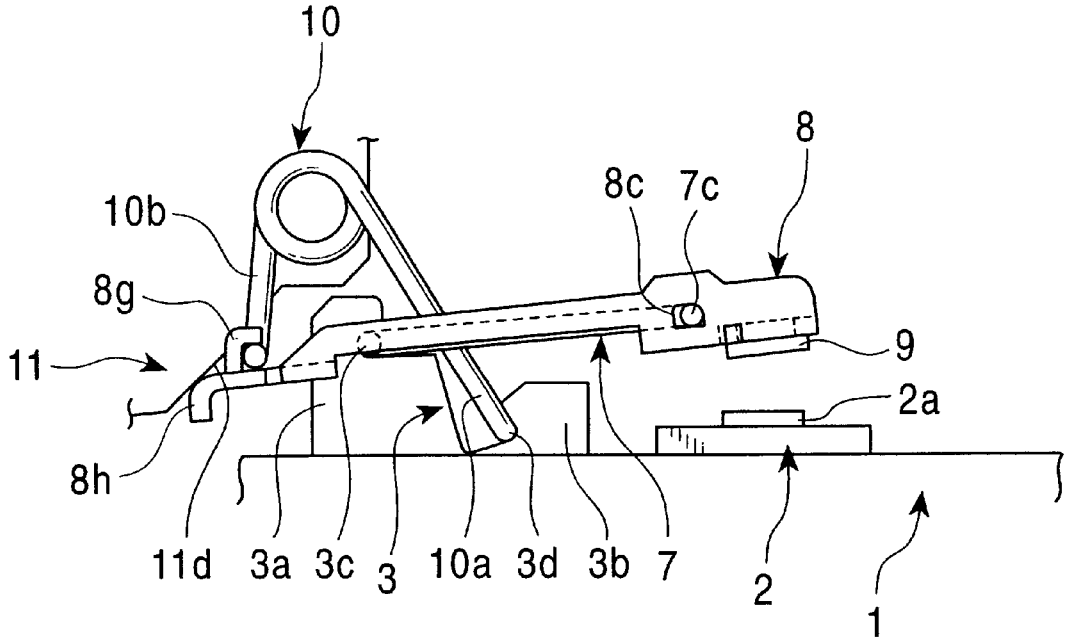
FIG. 9 is an explanatory view showing a state immediately before the conductor plate moves.
Figure 10:
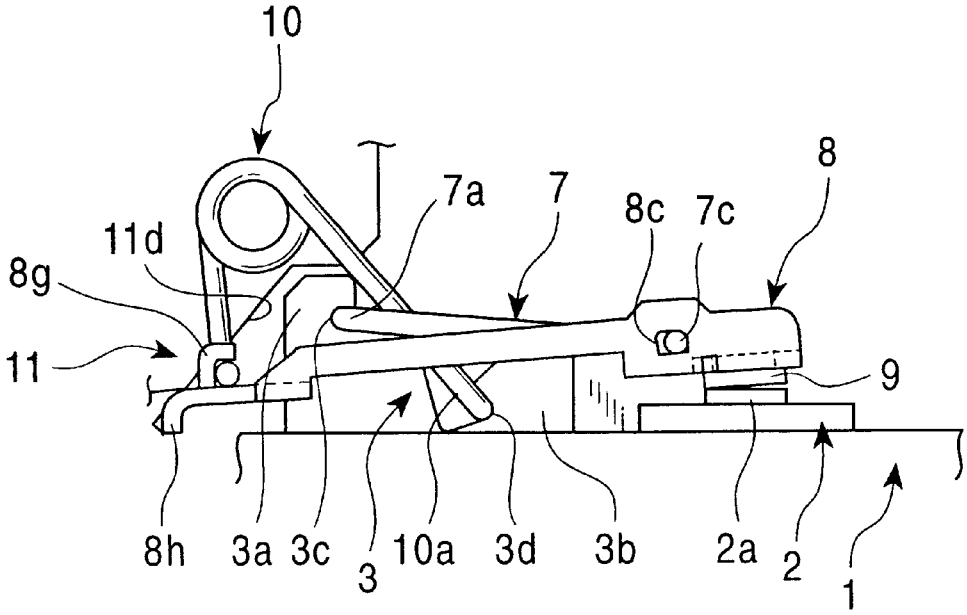
FIG. 10 is an explanatory view showing a state in which the conductor plate moves and contacts are closed.
Figure 11:
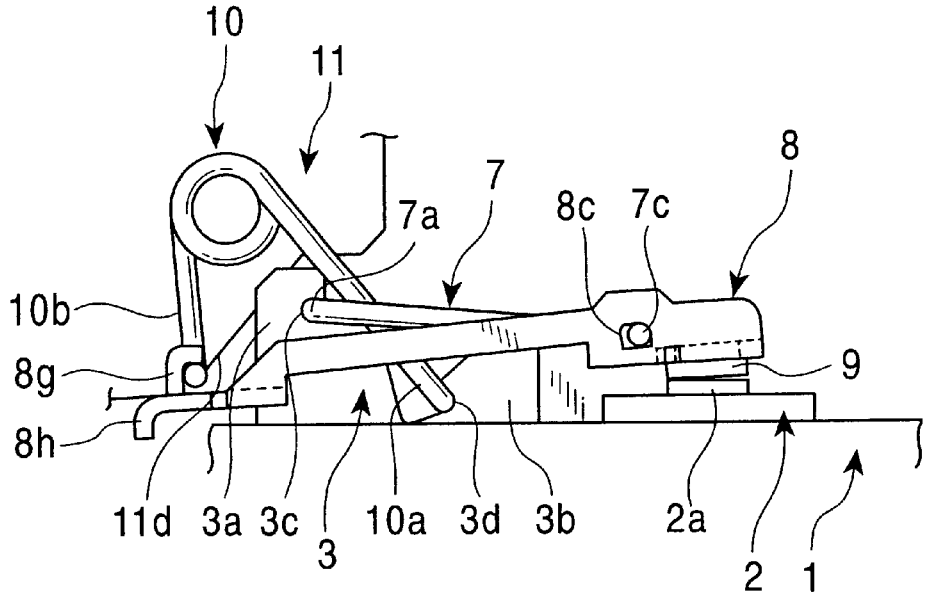
FIG. 11 is an explanatory view showing a state in which the slide member is pressed to its full-stroke position after being locked.
Figure 12:
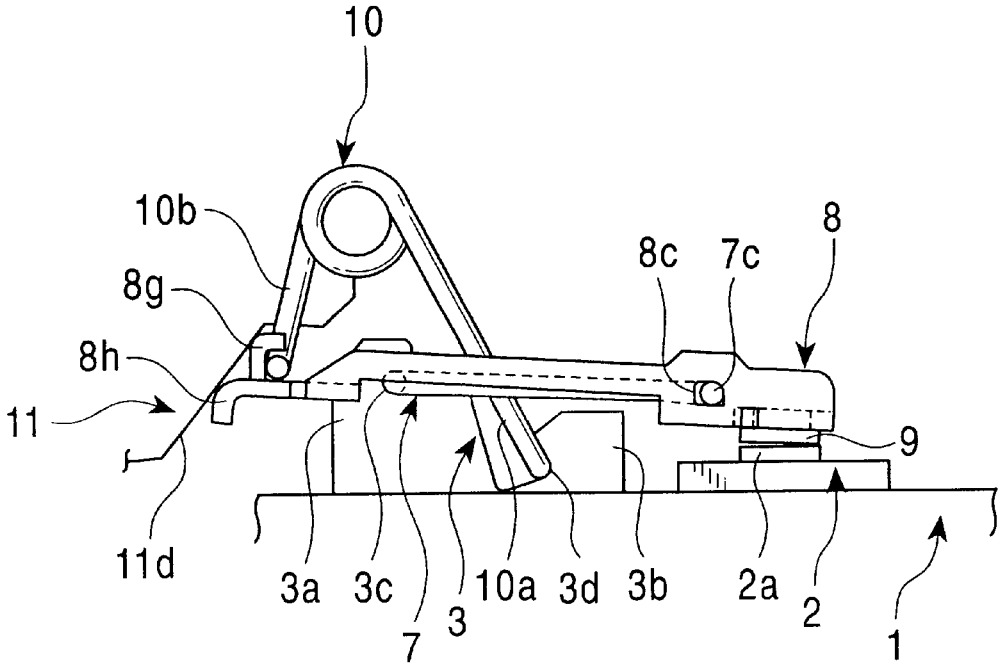
FIG. 12 is an explanatory view showing a state immediately before the slide member is unlocked and the conductor plate moves to open the contacts.
Figure 13:
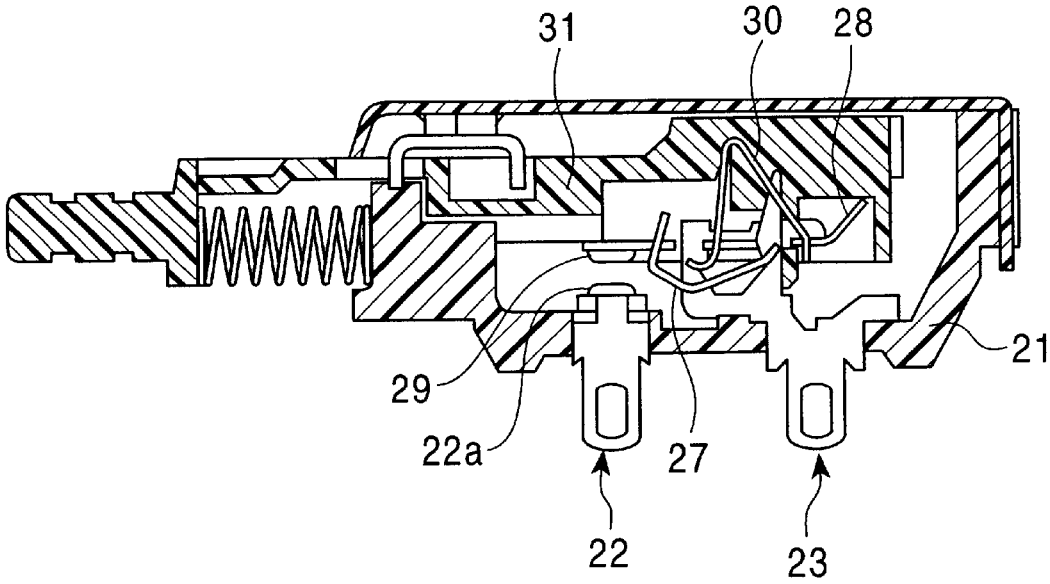
FIG. 13 PRIOR ART
FIG. 13 is a longitudinal sectional view showing an OFF state of a conventional switch device.
Figure 14:
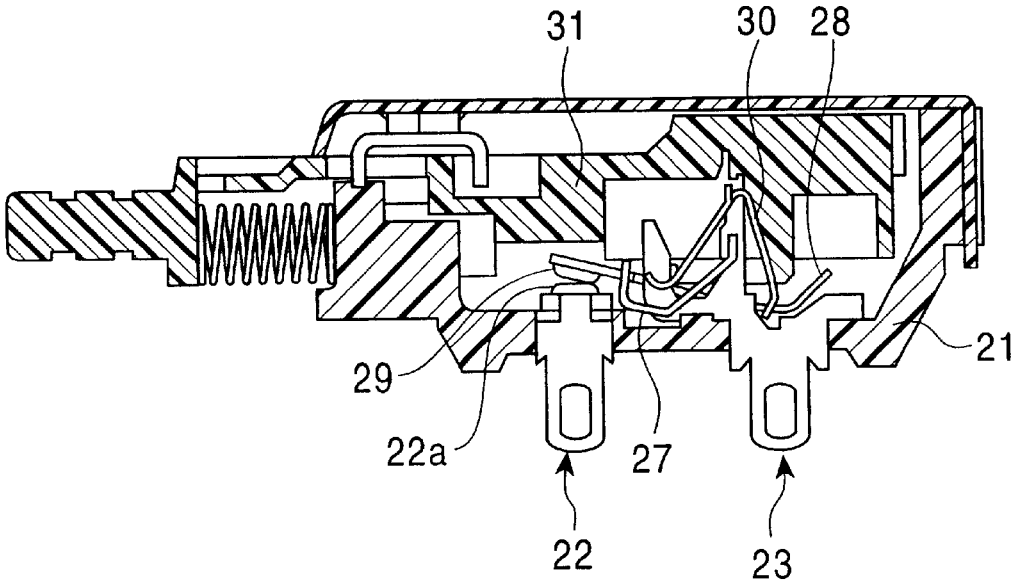
FIG. 14 PRIOR ART
FIG. 14 is a longitudinal sectional view showing an ON state of the switch device.
Figure 15:
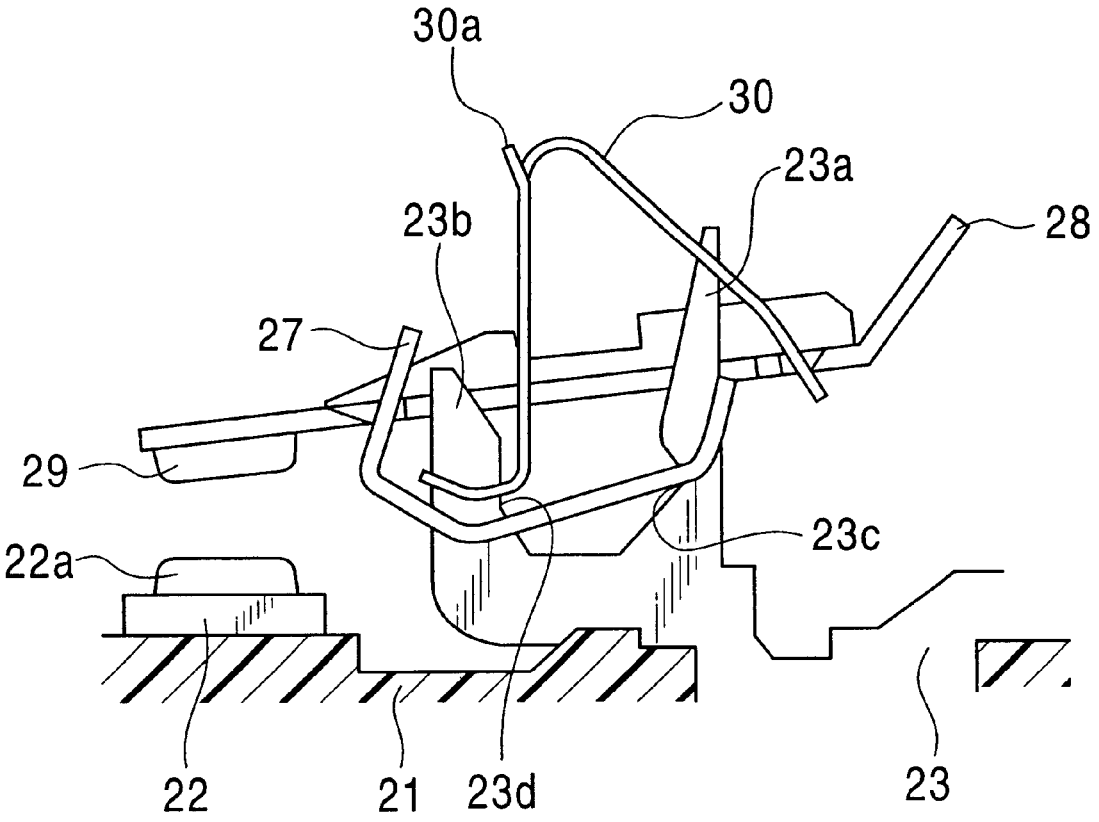
FIG. 15 PRIOR ART
FIG. 15 is a partial explanatory view of a conventional contact mechanism section.

FIGS. 1 to 12 show a switch device according to an embodiment of the present invention. FIG. 1 is a longitudinal sectional view showing an OFF state of the switch device, FIG. 2 is a longitudinal sectional view showing an ON state of the switch device, FIG. 3 is a plan view of the switch device in which a cover and a slide member are partly cut away, FIG. 4 is a sectional view of the switch device, taken along line IV—IV in FIG. 2, FIG. 5 is a plan view showing the engaging state of a conductor plate and a support arm, FIG. 6 is a front view showing the engaging state, and FIG. 7 is a side view showing the engaging state. FIGS. 8 to 12 are explanatory views showing the operating states of a contact mechanism section of the switch device. FIG. 8 is an explanatory view showing an initial (OFF) state of the contact mechanism section. FIG. 9 is an explanatory view showing a state immediately before the conductor plate moves. FIG. 10 is an explanatory view showing a state in which the conductor plate moves and contacts are closed. FIG. 11 is an explanatory view showing a state in which the slide member is pressed to its full-stroke position after being locked, and FIG. 12 is an explanatory view showing a state immediately before the slide member is unlocked and the conductor plate moves to open the contacts.

Referring to the figures, a casing 1 is made of an insulating material, such as a synthetic resin, and is shaped like a box that has an opening at the top. A pair of holding portions la is formed inside the opening of the casing 1. A fixed terminal 2 made of a conductive metal plate and having a fixed contact 2a on its upper surface, is placed on the inner bottom surface of each of the holding portions la, and a center terminal 3 similarly made of a conductive metal plate is placed adjacent thereto.

A slide member 11 is held in the holding portions la so as to be able to slide. The casing 1 has, at its leading end, a frame 4 made of a metal plate having a mounting leg 4*a* to be mounted on a circuit board or the like, and has, at its rear end, a mounting projection 1*b* on which a cover 12, which will be described later, is mounted. At the leading end of the casing 1, a shaft hole 1*c* is also formed so as to pivotally support one end of a lock pin 5 which is engaged, at the lock pin's other end with a lock cam 11*e* of the slide member 11, which will be described later, in order to lock the slide member 11 in a pressed position. At a position offset frontward from the shaft hole 1*c*, a return spring retaining portion 1*d* extends. One end of a return spring 6 for urging the slide member 11 to a return position is engaged with spring retaining portion 1*d*.

A support arm retaining projection 3*a* for retaining a support arm 7, which will be described later, and a spring retaining projection 3*b* for retaining a helical torsion spring 10, which will be described later, stand on the center terminal 3. The support arm retaining projection 3*a* and the spring retaining projection 3*b* have retaining grooves 3*c* and 3*d* respectively, which nearly opposed each other. The support arm 7 and the helical torsion spring 10 are retained, at one end, by the retaining grooves 3*c* and 3*d* respectively. The retaining grooves 3*c* and 3*d* are formed by arc-shaped surfaces in accordance with the wire diameters of the support arm 7 and the helical torsion spring 10.

The support arm 7 is made of a conductive, elastic, round wire and is substantially U-shaped. The support arm 7 has a retaining shaft 7*a* to be retained by the retaining groove 3*c* of the support arm retaining projection 3*a*, and a pair of opposing flexible arm pieces 7*b* extending from the retaining shaft 7*a*. Each of the arm pieces 7*b* has, at its leading end, a bent portion 7*c* to be rotatably engaged with a retaining hole 8*c* formed in a side wall 8*a* of a conductor plate 8, which will be described later. The support arm 7 is combined with the conductor plate 8 by engaging the bent portions 7*c* with the retaining holes 8*c*, and the arm pieces 7*b* are elastically urged toward the side walls 8*a* of the conductor plate 8 by their own elasticity.

The conductor plate 8 is similarly made of a conductive metal plate. The conductor plate 8 has opposing side walls 8*a* on both sides, and an open window portion 8*b* at the center. The pair of retaining holes 8*c* are respectively. formed in the side walls 8*a*, and the bent portions 7*c* of the support arm 7 are rotatably engaged therewith. Adjacent to the retaining holes 8*c*, regulating projections 8*e* each having an inclined face 8*d* are formed so as to contact the arm pieces 7*b* of the support arm 7. The inclined faces 8*d* of the regulating projections 8*e* project inwardly toward the upper surfaces of the side walls 8*a*.

By forming the regulating projections 8*e* on the side walls 8*a*, when the conductor plate 8 is shifted in a direction nearly perpendicular to the sliding direction and the movable contact 9 moves into contact with the fixed contact 2*a*, the arm pieces 7*b* move upward along the inclined faces 8*d* with the movement of the conductor plate 8. Therefore, the arm pieces 7*b* are compressed inward by the regulating projections 8*e*, and the elastic contact pressure with the inclined faces 8*d* is increased.

That is, since the arm pieces 7*b* of the support arm 7 are formed so as to be elastically urged against the side walls 8*a* of the conductor plate 8, a reliable connection is established between the support arm 7 and the conductor plate 8, and the conductor plate 8 and the center terminal 3 will not be disconnected due to bounce or chattering when the switch is turned on and off, which improves the reliability of the contact. Furthermore, since the regulating projections 8*e* are formed on the side walls 8*a*, the elastic contact pressure between the arm pieces 7*b* and the inclined faces 8*d* is increased with the movement of the conductor plate 8 toward the fixed contact 2*a*, which further improves the reliability of the contact.

The support arm 7 is loosely fitted in the window portion 8*b*, and the support arm retaining projection 3*a* and the helical torsion spring 10 are also loosely fitted therein. At one end of the window portion 8*b*, a guide groove 8*f* is formed to be fitted on and guided by the support arm retaining projection 3*a* when the conductor plate 8 is mounted on the center terminal 3. By forming the guide groove 8*f*, the conductor plate 8 is movably positioned and mounted on the center terminal 3.

The movable contact 9 is attached at one end of the conductor plate 8. At the same end, the retaining holes 8*c* are formed, and the bent portions 7*c* of the support arm 7 are engaged therewith. At the other end of the conductor plate 8, a hook portion 8*g* is formed so as to retain one end of the helical torsion spring 10. The conductor plate 8 is thereby movably mounted on the center terminal 3. At the position offset frontward from the hook portion 8*g*, arc-shaped contact portions 8*h* are formed so as to contact an operating face portion 11*d* of the slide member 11, which will be described later, in order to shift the conductor plate 8 in the direction nearly perpendicular to the sliding direction.

The helical torsion spring 10 serving as the spring member is formed by coiling a conductive, elastic, round wire, and has a pair of spring pieces 10*a* and 10*b*. One of the spring pieces 10*a* is retained by the retaining groove 3*d* of the spring retaining projection 3*b* of the center terminal 3, and the other spring piece 10*b* is retained by the hook portion 8*g* of the conductor plate 8. The helical torsion spring 10 is placed in a bent form between the center terminal 3 and the conductor plate 8. The conductor plate 8 is urged in a direction opposite from the position of the fixed contact 2*a* (away from the inner bottom surface of the holding portion 1*a*) by the urging force of the helical torsion spring 10.

Since the spring member is formed of the helical torsion spring 10, the shape thereof is simplified, machinablility and dimensional accuracy can be easily maintained, and the cost can be reduced, compared with a case in which a leaf spring or the like is formed by press-molding a metal plate. Furthermore, since the helical torsion spring 10 is made of a round wire of circular cross section, it is engaged with the retaining groove 3*d* of the center terminal 3 and the hook portion 8*g* of the conductor plate 7 on the arc-shaped portions. Therefore, smooth sliding is possible, scraping or the like are avoided, and the reliability of the contact is improved.

The slide member 11 is made of an insulating material, such as a synthetic resin, and has a base portion 11*a* placed in the holding portion 1*a* of the casing 1, and an operating portion 11*b* extending from the leading end of the base portion 11*a*. The base portion 11*a* has a conductor plate holding portion 11*c* for accommodating the conductor plate 8, the support arm 7, and the like. The conductor plate holding portion 11*c* has an inclined operating face portion 11*d* which slides in contact with the contact portions 8*h* of the conductor plate 8 so as to shift the conductor plate 8 in the direction nearly perpendicular to the sliding direction. At the leading end of the conductor plate holding portion 11*c*, a lock cam 11*e*, which slides in contact with the above-described lock pin 5, is formed so as to lock the slide member 11 in a pressed position. The operating portion 11*b* has a return spring holding portion 11*f* for accommodating the return spring 6 which urges the slide member 11 toward the return position.

The cover 12 is made of an insulating material, such as a synthetic resin, and is shaped like a rectangle. The cover 12 is mounted by a mounting arm portion 12*a* to be retained by the mounting projection 1*b* at the rear end of the casing 1, and the frame 4 at the leading end of the casing 1 so as to cover the opened holding portion 1*a* of the casing 1. On the upper side of the conductor plate 8 opposite from the movable contact 9, a projection 12*b* is formed in contact with the leading end of the conductor plate 8 so as to regulate the position of the conductor plate 8.

When assembling the contact mechanism of the switch device, the conductor plate 8 is mounted on the center terminal 3 disposed on the inner bottom surface of the casing 1. In this case, since the support arm 7 is elastically urged and engaged with the conductor plate 8, it is combined therewith in one piece. Therefore, only by loosely fitting the support arm retaining projection 3*a* of the center terminal 3 in the window portion 8*b* of the conductor plate 8 and fitting the retaining shaft 7*a* of the support arm 7 in the retaining groove 3*c* of the support arm retaining projection 3*a*, can the conductor plate 8 be easily assembled to the center terminal 3. In this case, the conductor plate 8 is positioned by the fitting of the support arm retaining projection 3*a* in the guide groove 8*f*.

In a state in which the helical torsion spring 10 is loosely fitted in the window portion 8*b* of the conductor plate 8, the helical torsion spring 10 is bent and retained between the hook portion 8*g* of the conductor plate 8 and the helical torsion spring retaining projection 3*b* of the center terminal 3, thereby completing the assembly of the contact mechanism.

In this case, the conductor plate 8 is urged in a direction opposite from the fixed terminal 2 in the holding portion 1*a* by the urging force of the helical torsion spring 10. The upper end face thereof, where the movable contact 9 is attached, contacts the projection 12*b* of the cover 12, and the contact portions 8*h* at the other end contact the operating face portion 11*d*. Thereby, the conductor plate 8 is placed in a substantially horizontal position in the holding portion 1a with a set space between the movable contact 9 and the fixed contact 2*a*.

The operation of the above-described switch device will now be described with reference to FIGS. 8 to 12.

In an initial state shown in FIG. 8, the movable contact 9 is placed at a set distance from the fixed contact 2*a*, and the switch is off. In this state, the conductor plate 8 is urged in a direction (upward) opposite from the fixed terminal 2 and the fixed contact 2*a* by the urging force of the helical torsion spring 10.

When the operating portion 11*b* of the slide member 11 is pressed against the urging force of the return spring 6 in this initial state, the operating face portion 11*d* of the slide member 11 presses down the contact portions 8*h* of the conductor plate 8 toward the inner bottom surface of the holding portion 1*a* against the urging force of the helical torsion spring 10, as shown in FIG. 9.

In this case, when the retaining portion between the helical torsion spring 10 and the conductor plate 8 overlaps with the retaining portion between the support arm 7 and the center terminal 3 (the retaining groove 3*c* of the support arm retaining projection 3*a*), as shown in FIG. 9, the direction of the urging force of the helical torsion spring 10 is turned to the downward direction, the conductor plate 8 moves toward the inner bottom surface of the holding portion 1*a*, and the movable contact 9 contacts the fixed contact 2*a*, thereby turning the switch on.

When the slide member 11 is further pressed in this ON state, as shown in FIG. 10, the contact portions 8*h* of the conductor plate 8 are further pressed downward by the operating face portion 11*d* of the slide member 11, and the movable contact 9 is pressed against the fixed contact 2*a* by the urging force of the helical torsion spring 10, thereby making the contact more reliable. In this case, the slide member 11 is locked in a pressed position with the cooperation of the lock pin 5 and the lock cam 11*e*.

In order to perform unlocking in this state, the operating portion 11*b* of the slide member 11 is further pressed, as shown in FIG. 11. The lock pin 5 is thereby disengaged from the lock cam 11*e*, and the slide member 11 is returned to the initial position by the urging force of the return spring 6. In this case, when the retaining portion between the conductor plate 8 and the helical torsion spring 10 passes over the retaining portion between the support arm 7 and the center terminal 3 (the retaining groove 3*c* of the support arm retaining projection 3*a*), as shown in FIG. 12, the direction of the urging force of the helical torsion spring 10 is turned to the upward direction, the conductor plate 8 moves in a direction opposite from the inner bottom surface of the holding portion 1*a*, and the movable contact 9 separates from the fixed contact 2*a*, thereby turning the switch off and bringing about the initial state shown in FIG. 8 again.

According to the above-described embodiment of the present invention, the support arm 7, which is retained by the conductor plate 8 at one end and by the center terminal 3 at the other end, and the spring member 10, which is placed in a bent form between the conductor plate 8 and the center terminal 3 so as to movably support the conductor plate 8 on the center terminal 3, are made of an elastic round wire, and the support arm 7 and the spring member 10 are retained by the conductor plate 8 and the center terminal 3 on arc-shaped surfaces. Therefore, the shape is simplified, the material yield is improved, and machinablility and dimensional accuracy can be easily maintained. Moreover, since the center terminal 3 and the conductor plate 8 are contacted with each other on the arc-shaped surfaces, abrasion is prevented, and the reliability of the contact is improved.

While one end of the support arm 7 is retained by the conductor plate 8 on the same side as the side where the movable contact 9 is attached in the above embodiment, it may be retained on the opposite side. In this case, the helical torsion spring 10 and the conductor plate 8 are retained on the side where the movable contact 9 is attached. Of course, advantages similar to those in the above configuration can be obtained.

While the present invention has been described with reference to what is presently considered to be the preferred embodiment, it is to be understood that the invention is not limited to the disclosed embodiment. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A switch device comprising:

a fixed contact;

a conductor plate having a movable contact that is movable closer to and further apart from said fixed contact;

a center terminal for movably supporting said conductor plate;

a support arm retained by said conductor plate at one end of said support arm and retained by said center terminal at an other end of said support arm;

a spring member placed in a bent form between said conductor plate and said center terminal so as to movably support said conductor plate on said center terminal in cooperation with said support arm; and a slide member for moving said movable contact closer to and further apart from said fixed contact by shifting said conductor plate in a direction nearly perpendicular to a sliding direction by an elastic force of said spring member, wherein said support arm and said spring member are made of an elastic wire, and portions of said support arm and said spring member retained by said conductor plate and said center terminal are formed of arc-shaped surfaces.

2. A switch device according to claim 1, wherein said support arm has a pair of opposing flexible arm pieces, and said arm pieces are elastically urged toward side walls of said conductor plate.

3. A switch device according to claim 2, wherein each of said side walls has a regulating projection with an inclined surface, and said arm pieces are put into elastic contact with said inclined surfaces when said conductor plate shifts in the direction perpendicular to the sliding direction and said movable contact moves in such a direction as to contact with said fixed contact.

4. A switch device according to claim 1, wherein said spring member is formed of a helical torsion spring.

5. A switch device according to claim 1, wherein:

said slide member has an operating face portion formed of an inclined surface;

said conductor plate has a contact portion to be contacted with said operating face portion; and said operating face portion slides in contact with said contact portion with the sliding of said slide member so as to shift said conductor plate in the direction nearly perpendicular to the sliding direction.

* * * * *